US011193316B2

(12) United States Patent
Davis et al.

(10) Patent No.: US 11,193,316 B2
(45) Date of Patent: Dec. 7, 2021

(54) SHOWER DOOR HINGE ASSEMBLY

(71) Applicant: Kohler Mira Limited, Cheltenham (GB)

(72) Inventors: Scott Davis, Cheltenham (GB); Christos Nakos, Cheltenham (GB)

(73) Assignee: KOHLER MIRA LIMITED, Gloucestershire (GB)

( * ) Notice: Subject to any disclaimer, the term of this patent is extended or adjusted under 35 U.S.C. 154(b) by 75 days.

(21) Appl. No.: 16/723,849

(22) Filed: Dec. 20, 2019

(65) Prior Publication Data

US 2020/0123822 A1 Apr. 23, 2020

Related U.S. Application Data

(63) Continuation of application No. PCT/GB2018/051820, filed on Jun. 28, 2018.

(30) Foreign Application Priority Data

Jun. 29, 2017 (GB) ..... 1710442

(51) Int. Cl.
*E05D 5/02* (2006.01)
*E05D 5/06* (2006.01)
(Continued)

(52) U.S. Cl.
CPC ..... *E05D 5/06* (2013.01); *A47K 3/36* (2013.01); *E05D 11/06* (2013.01); *E05Y 2900/114* (2013.01)

(58) Field of Classification Search
CPC ..... E05D 11/06; E05D 5/0246; E05D 5/06; E05D 2005/0261; E05D 2005/0269;
(Continued)

(56) References Cited

U.S. PATENT DOCUMENTS 2,876,874 A * 3/1959 Benham ..... E05D 5/0215 49/381
3,781,944 A * 1/1974 Gianardi ..... E05D 5/0215 16/252

(Continued)

FOREIGN PATENT DOCUMENTS

DE 38 07 207 9/1989
DE 39 01 395 8/1990

(Continued)

OTHER PUBLICATIONS

UK Search Report Application No. GB1710442.3 dated Feb. 8, 2018.

(Continued)

*Primary Examiner* — Chuck Y Mah
(74) *Attorney, Agent, or Firm* — Foley & Lardner LLP

(57) ABSTRACT

A hinge assembly for a shower door includes a first panel rotatably connected to a second panel. A first hinge member has a first body portion for attachment to the first panel and a first neck portion, the first hinge member being arranged to allow rotation of the first panel with respect to the second panel about a hinge axis. The first body portion is arranged to be connected to the first panel so as to lie at least partially within a recessed region thereof, such that the hinge axis lies within a footprint of the first panel. The hinge assembly further comprises a second hinge member having a second body portion for attachment to the second panel such that the hinge axis lies outside a footprint of the second panel, and a second neck portion arranged to be rotatably connected to the first neck portion to allow the rotation.

17 Claims, 6 Drawing Sheets

(51) Int. Cl.
*A47K 3/36* (2006.01)
*E05D 11/06* (2006.01)

(58) Field of Classification Search
CPC ... E05F 1/1284; E05F 3/20; E05F 5/02; E05F 5/08; E05F 15/614; E05F 11/385; E05Y 2201/212; E05Y 2201/224; E05Y 2900/114; E05Y 2900/142; E05Y 2900/146; E05Y 2900/148; E05Y 2600/502; E05Y 2600/60; E06B 3/54; A47K 3/36; A47K 3/362; A47K 2003/367; A47F 3/12; A47F 3/125; Y10T 16/534; Y10T 16/541; Y10T 16/5257
See application file for complete search history.

(56) References Cited

U.S. PATENT DOCUMENTS 3,890,671 A * 6/1975 Fantoni ..... E05D 5/02 16/237
4,922,987 A * 5/1990 Marontate ..... E05D 15/26 160/183
5,097,543 A * 3/1992 Oille ..... A47K 3/36 160/210
5,265,309 A * 11/1993 Oille ..... A47K 3/36 16/262
6,092,263 A * 7/2000 Boue ..... E05D 3/12 16/286
6,704,966 B1 * 3/2004 Kao ..... E05D 5/0246 16/252
8,234,753 B2 * 8/2012 Cook ..... E05D 7/1011 16/262
9,297,190 B2 * 3/2016 Lee ..... E05D 3/122
10,125,527 B2 * 11/2018 Smalls ..... E05D 5/14

FOREIGN PATENT DOCUMENTS

DE 20304389.8 7/2003
DE 10 2008 006 522 6/2009
EP 1 331 335 7/2003
EP 2 098 148 9/2009
GB 2511507 A * 9/2014 ..... E05D 5/06
WO WO-2004/035975 4/2004
WO WO-2004038126 A1 * 5/2004 ..... E04F 11/1851

OTHER PUBLICATIONS

UK Search Report Application No. GB1710442.3 dated Nov. 24, 2017.
GB Examination Report on GB Patent Application No. 1710442.3 dated Jul. 1, 2021 (3 pages).

* cited by examiner

SHOWER DOOR HINGE ASSEMBLY

CROSS-REFERENCE TO RELATED PATENT APPLICATIONS

This application is a Continuation of International Application No. PCT/GB2018/051820, filed Jun. 28, 2018, which claims the benefit of and priority to United Kingdom Priority Application No. 1710442.3, filed Jun. 29, 2017. The entire disclosures of International Application No. PCT/GB2018/051820 and United Kingdom Priority Application No. 1710442.3, including their specifications, drawings, claims and abstracts, are incorporated herein by reference in their entireties.

BACKGROUND

The present application relates to a hinge assembly for a shower door, and in particular to a hinge assembly that can be attached to a shower door and another shower cubicle panel without requiring either the door or the panel to have a frame. More specifically, the application relates to a hinge assembly for a frameless shower door, and a shower cubicle comprising such a hinge assembly.

In the prior art, framed and frameless shower doors are known. Framed shower doors fit engagingly within their frames when closed, so reducing or preventing the escape of water from a shower cubicle. Frameless shower doors are popular due to their aesthetics, but, as there is not a frame to receive the shower door engagingly, water can escape between the shower door and a shower cubicle panel to which it is attached.

Additionally, relative movement of moveable parts of a hinge assembly can lead to surface scratches on components, which are ugly and particularly deleterious in the warm and wet environment associated with showers, which increases the likelihood of rust or mould developing in the scratches.

It would be advantageous to provide an improved hinge assembly that addresses one or more of the above-identified issues. These and other advantages will be apparent to those reviewing the present disclosure.

SUMMARY

An exemplary embodiment relates to a hinge assembly for a shower door that includes a first panel rotatably connected to a second panel The hinge assembly includes a first hinge member having a first body portion arranged to be attached to the first panel and also having a first neck portion, the first hinge member being arranged to allow rotation of the first panel with respect to the second panel about a hinge axis, wherein at least a portion of the first body portion is arranged to be connected to the first panel so as to lie at least partially within a recessed region of the first panel, such that the hinge axis lies within a footprint of the first panel. The hinge assembly also includes a second hinge member having a second body portion arranged to be attached to the second panel such that the hinge axis lies outside a footprint of the second panel, and also having a second neck portion arranged to be rotatably connected to the first neck portion to allow the rotation of the first panel with respect to the second panel about the hinge axis. The first and second neck portions have narrower widths than the first and second body portions and are shaped to prevent the hinge members from colliding with each other as the panels rotate towards each other, the widths being measured parallel to panel width of the respective first or second panel, and wherein cooperating surfaces of the body portion and the neck portion are shaped to cooperate with each other such that, as the angle between the panels decreases, the cooperating surface of the body portion of one hinge member is received within a space provided by the narrowing of the other hinge member in the region of the neck portion.

Another exemplary embodiment relates to a shower door that includes a first panel comprising a recessed region, a second panel, and a hinge assembly. The hinge assembly includes a first hinge member having a first body portion arranged to be attached to the first panel and also having a first neck portion, the first hinge member being arranged to allow rotation of the first panel with respect to the second panel about a hinge axis, wherein at least a portion of the first body portion is arranged to be connected to the first panel so as to lie at least partially within a recessed region of the first panel, such that the hinge axis lies within a footprint of the first panel. The hinge assembly also includes a second hinge member having a second body portion arranged to be attached to the second panel such that the hinge axis lies outside a footprint of the second panel, and also having a second neck portion arranged to be rotatably connected to the first neck portion to allow the rotation of the first panel with respect to the second panel about the hinge axis. The first and second neck portions have narrower widths than the first and second body portions and are shaped to prevent the hinge members from colliding with each other as the panels rotate towards each other, the widths being measured parallel to panel width of the respective first or second panel, and wherein cooperating surfaces of the body portion and the neck portion are shaped to cooperate with each other such that, as the angle between the panels decreases, the cooperating surface of the body portion of one hinge member is received within a space provided by the narrowing of the other hinge member in the region of the neck portion.

Another exemplary embodiment relates to a shower cubicle comprising a hinge assembly. The hinge assembly includes a first hinge member having a first body portion arranged to be attached to the first panel and also having a first neck portion, the first hinge member being arranged to allow rotation of the first panel with respect to the second panel about a hinge axis, wherein at least a portion of the first body portion is arranged to be connected to the first panel so as to lie at least partially within a recessed region of the first panel, such that the hinge axis lies within a footprint of the first panel. The hinge assembly also includes a second hinge member having a second body portion arranged to be attached to the second panel such that the hinge axis lies outside a footprint of the second panel, and also having a second neck portion arranged to be rotatably connected to the first neck portion to allow the rotation of the first panel with respect to the second panel about the hinge axis. The first and second neck portions have narrower widths than the first and second body portions and are shaped to prevent the hinge members from colliding with each other as the panels rotate towards each other, the widths being measured parallel to panel width of the respective first or second panel, and wherein cooperating surfaces of the body portion and the neck portion are shaped to cooperate with each other such that, as the angle between the panels decreases, the cooperating surface of the body portion of one hinge member is received within a space provided by the narrowing of the other hinge member in the region of the neck portion.

BRIEF DESCRIPTION OF THE DRAWINGS

There now follows by way of example only a detailed description of embodiments of the present application with reference to the accompanying drawings in which.

DETAILED DESCRIPTION

According to a first aspect, there is provided a frameless shower door which allows for a reduced gap between the door and a panel to which it is hinged. There is provided a hinge assembly for a shower door comprising a first panel rotatably connected to a second panel. The hinge assembly includes a first hinge member having a first body portion arranged to be attached to the first panel and also having a first neck portion, the first hinge member being arranged to allow rotation of the first panel with respect to the second panel about a hinge axis, wherein at least a portion of the first body portion is arranged to be connected to the first panel so as to lie at least partially within a recessed region of the first panel, such that the hinge axis lies within a footprint of the first panel. The hinge assembly also includes a second hinge member having a second body portion arranged to be attached to the second panel such that the hinge axis lies outside a footprint of the second panel, and also having a second neck portion arranged to be rotatably connected to the first neck portion to allow the rotation of the first panel with respect to the second panel about the hinge axis. The first and second neck portions are narrower than the first and second body portions and shaped to prevent the hinge members from colliding with each other.

Figure 1:
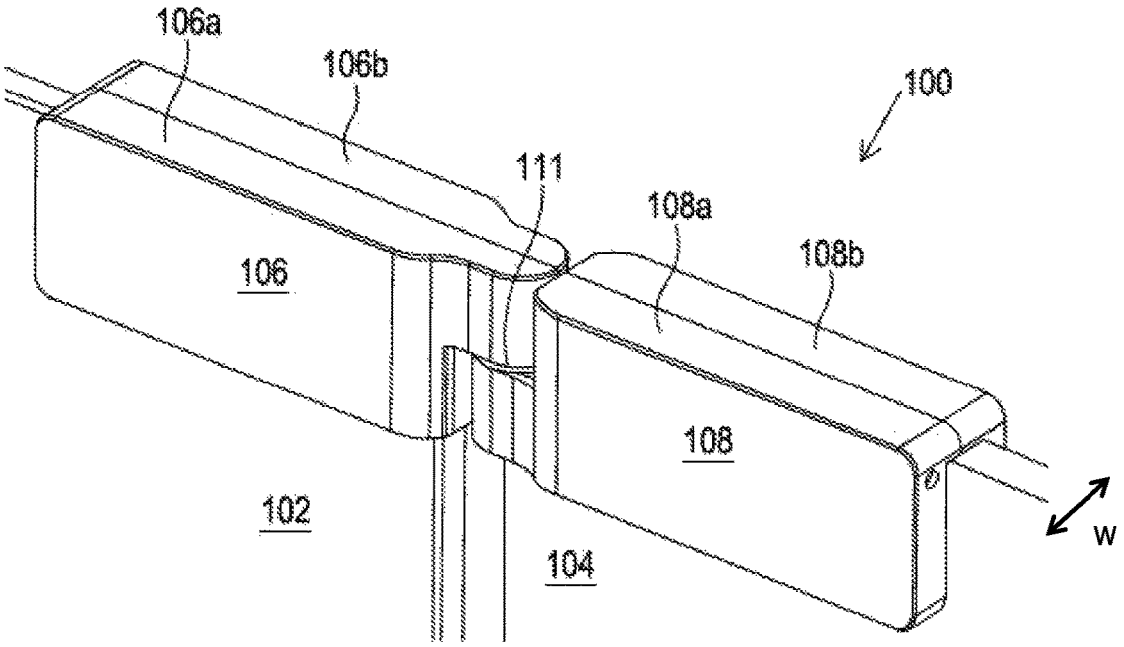
FIG. 1 shows a portion of a shower cubicle according to an embodiment of the application.
Figure 4:
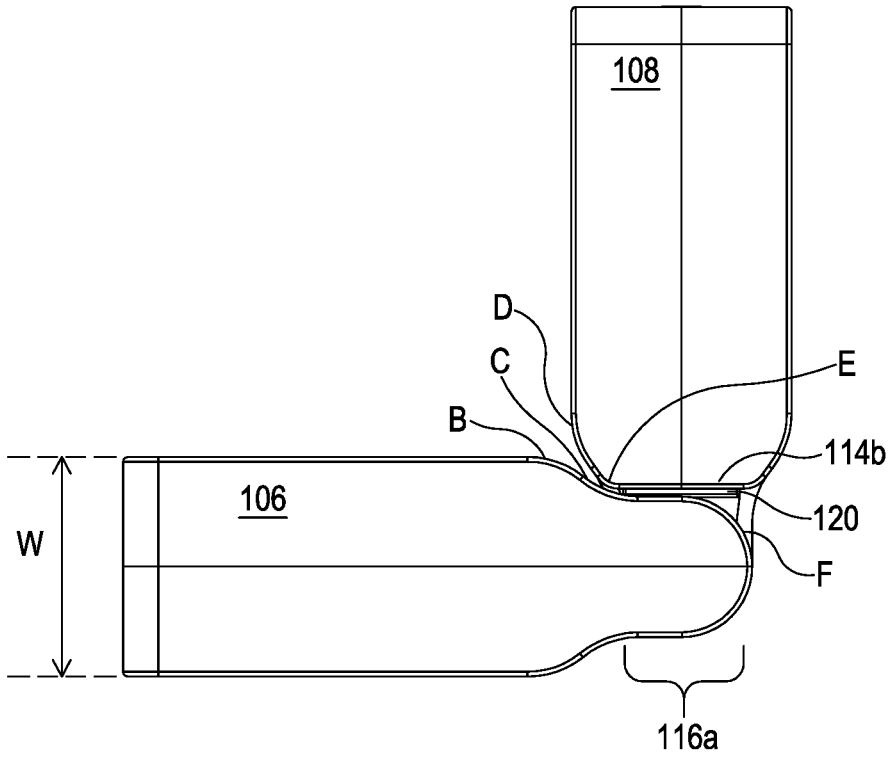
FIG. 4 is a schematic representation of the portion of a shower cubicle shown in FIG. 1 in a different position.
Figure 5:
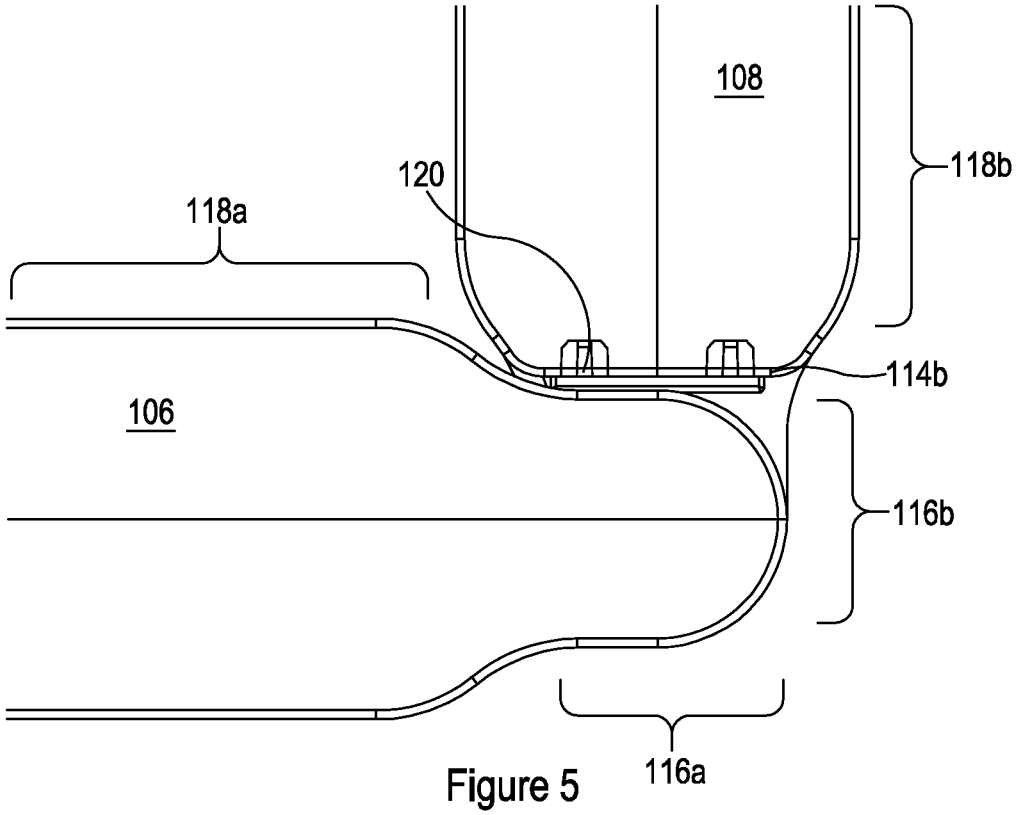
FIG. 5 shows a cross-sectional view of the portion of a shower cubicle shown in FIG. 4.

The first and second neck portions are narrower than the body portions in that the neck portions have narrower widths than the first and second body portions, the widths being measured parallel to panel width of the respective first or second panel (i.e. perpendicular to the large face of the panel to which the relevant hinge member is connected). An arrow marked W is shown in FIGS. 1 and 4 to illustrate width. The width may be perpendicular to the hinge axis. Each hinge members is therefore narrower in its neck region than in its body region.

Each hinge member may be thought of as having a length extending from one end of the body portion, across that body portion, and across the neck portion extending therefrom. The width of the hinge narrows from the body portion region of this length to the neck portion region of this length. The narrowing may be staged—for example having a constant width for at least a portion of the body portion, narrowing where the neck meets the body, a second (smaller) constant width for at least a portion of the neck portion, and narrowing to a curved end region. The neck portion may not have a portion of constant width in some embodiments.

The first and second neck portions are connected at the hinge axis; the hinge members are therefore narrower where they connect to each other than where they connect to the panels. The skilled person will appreciate that, to enclose the panel, the body portions are wider than the panel in the embodiment shown. By contrast, the neck portion extends away from the panel and/or within a recessed region of the first panel, so does not need to be wider than the panel.

The first and second neck portions may be shaped to prevent the hinge members from colliding at any angle of rotation of the panels.

The first and second neck portions may be shaped to prevent collision as the panels rotate towards each other. In particular, this may assist in avoiding collision when the angle between the panels reduces, for example approaching 120°, or 90°. In particular, collision is avoided as the panels are moved closer together. In some embodiments, the angle between the panels may reduce to below 90°.

The body portion of one hinge member may lie adjacent to a side of a neck portion of the other hinge member at some angles in some embodiments (for example when the angle between the panels is around 90°)—the body portion may be received in a space provided by the narrowing of the other hinge member in its neck portion. The narrowing may allow the hinge portions to adopt a configuration that would otherwise be blocked or cause a collision.

Advantageously, collisions as the angle between the panels becomes smaller, e.g. moves away from 180°, can therefore be avoided. Scraping or collisions of the panels as the shower door is opened and/or closed can therefore be reduced or avoided. The skilled person will appreciate that for panels which are adjacent at one edge and parallel when the panel forming the door is in a closed position (180° angle between the panels), a decrease in angle occurs as the door is opened. By contrast, for panels which are adjacent at one edge and perpendicular when the panel forming the door is in a closed position, a reduction in angle may occur when the door is either opened or closed. In many such cases, the fully open position would have a 180° angle between the panels. The skilled person will appreciate that other angles between panels when in a closed position may occur in other designs falling within the scope of this disclosure.

The hinge assembly may have a cooperating surface of the body portion of each hinge member shaped to cooperate with a surface of the neck portion of the other hinge member such that water egress between the cooperating surface and the neck is substantially blocked at any angle of rotation of the panels.

The first hinge member and the second hinge member may be symmetrical and be at least substantially shaped to be mirror images of each other, such that the hinge assembly is unhanded.

The neck portion of each hinge member may extend from the body portion. The neck portion of each hinge member may be arranged to lie vertically adjacent to the neck portion extending from the other hinge member and horizontally adjacent to a/the cooperating surface of the body portion of the other hinge member.

The cooperating surface of the body portion and the neck portion may be shaped to cooperate with each other such that, as the angle between the panels decreases, the cooperating surface of the body portion of one hinge member is received within a space provided by the narrowing of the other hinge member in the region of the neck portion.

The cooperating surface may be substantially flat for at least 50% of the width of the body portion.

The neck portion may be curved. The cooperating surface may be substantially parallel to the tangent to the curve of the neck portion of the opposing hinge member at the closest point between the neck portion and the cooperating surface at all angles of rotation.

The end region of the neck portion arranged to cooperate with the opposing hinge member may be curved.

The end region of the neck portion arranged to cooperate with the opposing hinge member may be substantially semi-circular in cross-section. The diameter of the substantially semi-circular end region may be between 45% and 75% of the thickness of the body portion, preferably between 60% and 70%, and more preferably around 65% of the thickness.

The hinge assembly may be arranged such that a gap between the panels is narrow, and optionally has a maximum width of 13 mm at any angle of rotation.

The hinge assembly may comprise at least one stop-pad, the or each stop-pad being arranged to be attached to either the first hinge member of the second hinge member and arranged to prevent contact between a surface of the first hinge member and a surface of the second hinge member at any angle of rotation.

The hinge assembly may comprise two stop-pads, one on the cooperating surface of the first hinge member and one on the cooperating surface of the second hinge member.

Each hinge member may comprise a screw cover arranged to follow the profile of the hinge member, cover any screws, and provide a uniform, unhanded shape to the hinge member.

According to a second aspect, there is provided a shower door comprising:

a first panel comprising a recessed region;

a second panel; and a hinge assembly comprising:

a first hinge member having a first body portion arranged to be attached to the first panel and also having a first neck portion, the first hinge member being arranged to allow rotation of the first panel with respect to the second panel about a hinge axis, wherein at least a portion of the first body portion is arranged to be connected to the first panel so as to lie at least partially within a recessed region of the first panel, such that the hinge axis lies within a footprint of the first panel; and a second hinge member having a second body portion arranged to be attached the second panel such that the hinge axis lies outside a footprint of the second panel, and also having a second neck portion arranged to be rotatably connected to the first neck portion to allow the rotation of the first panel with respect to the second panel about the hinge axis, wherein the first and second neck portions are narrower than the first and second body portions and shaped to prevent the hinge members from colliding with each other.

According to a third aspect, there is provided a shower cubicle including at least one of the following:

(i) one or more hinge assemblies according the first aspect; and/or (ii) a shower door according to the second aspect.

According to a fourth aspect, there is provided a hinge assembly for a shower door comprising a first panel rotatably connected to a second panel, the hinge assembly comprising:

a first hinge member arranged to be attached to the first panel;

a second hinge member arranged to be attached to the second panel and to be rotatably connected to the first hinge member so as to allow the rotation of the first panel with respect to the second panel; and one or more stop-pads, each arranged to be attached to either the first hinge member of the second hinge member and arranged to prevent contact between a surface of the first hinge member and a surface of the second hinge member at any angle of rotation.

The stop-pad may comprise one or more protrusions arranges to cooperate with indentations in the hinge member to which it is arranged to be attached so as to secure the stop-pad to the hinge member.

The stop-pad may be made of a compressible, resilient material.

The stop-pad may be made of Acetal or Nylon, particularly Nylon 6,6.

The stop-pad may be around 1 mm thick.

The stop-pad may be less than or equal to 1.5 mm in thickness.

Each hinge member may have a body portion arranged to be attached to a panel and a neck portion extending from the body portion, wherein a cooperating surface of the body portion of each hinge member may be shaped to cooperate with a surface of the neck portion of the other hinge member. The stop-pad may be attached to the cooperating surface of the body portion, or to the neck portion.

According to a fifth aspect, there is provided a shower door assembly comprising:

a first panel;

a second panel; and a hinge assembly according to the fourth aspect.

According to a sixth aspect, there is provided a shower cubicle including at least one of the following:

(i) one or more hinge assemblies according to the fourth aspect; and/or (ii) a shower door assembly according to the fifth aspect.

The skilled person would understand that features described with respect to one aspect may be applied, mutatis mutandis, to the other aspect.

Referring to FIG. 1, The shower door assembly 100 shown in FIG. 1 comprises a first panel 102 rotatably connected to a second panel 104. In the embodiment shown, the first panel 102 forms a shower door 102 and the second panel 104 is a panel 104 of a shower cubicle, the shower cubicle including the shower door assembly 100.

The shower door assembly 100 further comprises a first hinge member 106. The first hinge member 106 is rigidly attached to the first panel 102, i.e. to the shower door 102.

The shower door assembly 100 further comprises a second hinge member 108. The second hinge member 108 is rigidly attached to the second panel 104, i.e. to the cubicle panel 104.

The second hinge member 108 is rotatably connected to the first hinge member 106. The second hinge member 108 and the first hinge member 106 together may be referred to as a hinge assembly.

The cooperation of the first hinge member 106 and the second hinge member 108 allows rotation of the shower door 102 with respect to the cubicle panel 104.

Rotation is about a hinge axis. The hinge axis lies within the footprint of the cubicle panel 104 and outside of the footprint of the shower door 102.

In the embodiment being described, the first and second hinge members 106, 108 are each made of two parts 106*a*, 106*b*, 108*a*, 108*b*

In the embodiment being described, the first part 106*a*, 108*a* is larger than the second part 106*b*, 108*b*. The second part 106*b*, 108*b* may be thought of as a cover, as can be seen more clearly in FIG. 10. The cover 300 serves to cover the heads of tightening means such as screws (not shown) which are used to tighten the first part 106*a*, 106*b* so as to clamp the panel 102, 104 within the slot 600 in the first part 106*a*, 106*b*. The panel 102, 104 is therefore partially enclosed within the hinge member 106, 108.

The panel 102, 104 is clamped and thereby held in place; the hinge assembly 100 may therefore be described as a clamp hinge.

Figure 7:
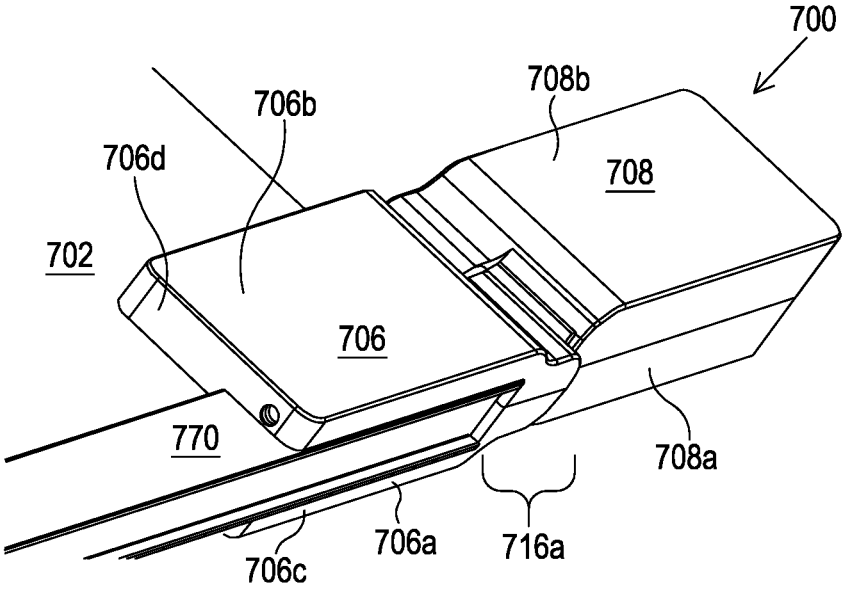
FIG. 7 shows use of a hinge assembly as described herein retrofitted to a prior art shower door.

In alternative embodiments, such as that shown in FIG. 7, the two parts 706*a*, 706*b* may be mirror images of each other, shaped to allow a portion of the panel 702 to be located therebetween and so partially enclosed within the hinge member 706. The two parts 706*a*, 706*b*, 708*a*, 708*b* in such embodiments are arranged to be attached together so as to clamp the panel 702 therebetween, so securing the hinge member 706, 708 to its respective panel 702.

In such embodiments, each part 706*a*, 706*b*, 708*a*, 708*b* comprises a plate 706*c*, 706*d* extending from a joining portion. When two parts 706*a*, 706*b* are connected to form the hinge member 706, the plates 706*c*, 706*d* extend parallel to, and spaced from, each other. The joining portions are sized such that connecting the two parts 706*a* spaces the plates 706*c*, 706*d* correctly to grip the panel 702 (so forming an equivalent of the slot 600 of the embodiment shown in FIGS. 4, 6 and 10). The plates 706*a*, 706*b* of one hinge member 706 are joined by the neck portion 716*a*, which is located at the end of the plates 706*a*, 706*b* nearest to the hinge axis, and there is no additional joining portion between the plates 706*a*, 706*b*.

By contrast, in alternative embodiments, such as hinge member 708 shown in FIG. 7 (described in more detail below), the joining portions combine to form a smooth upper surface to the hinge member 708. In use, the upper surface is arranged to sit on top of the panel (not shown). The skilled person will appreciate that whether the second part 106*b*, 706*b*, 708*b* is a cover 300 or a mirror image of the first part, the same or equivalent changes to the joining sections may be made for retrofitting purposes, in various embodiments.

In the embodiments being described with respect to FIG. 7, the two parts 706*a*, 706*b*, 708*a*, 708*b* of each hinge member 706, 708 are connected using screws. The screws are tightened so as to allow the panel 702 to be gripped. The skilled person will appreciate that any other suitable attachment and/or adjustment means may be used.

In alternative embodiments, each hinge member 106, 108, 706 may be formed from a single part having an equivalent shape. The plates of such a single part may have a certain amount of flexibility such that a panel can be pushed between them, and gripped. Again, screws or any other suitable adjustment means may be used to clamp the panel 102, 104, 702 between the plates 108*c*, 108*d*, 706*d*.

Figure 2:
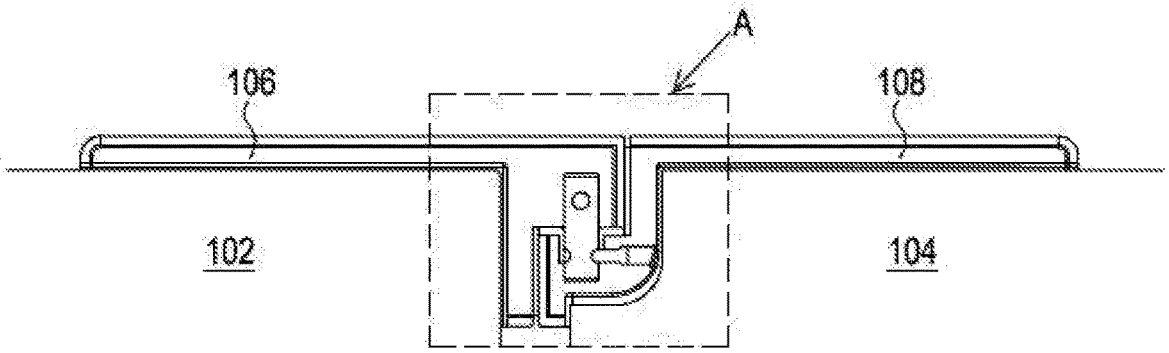
FIG. 2 shows a cross-sectional view of the portion of a shower cubicle shown in FIG. 1.
Figure 3:
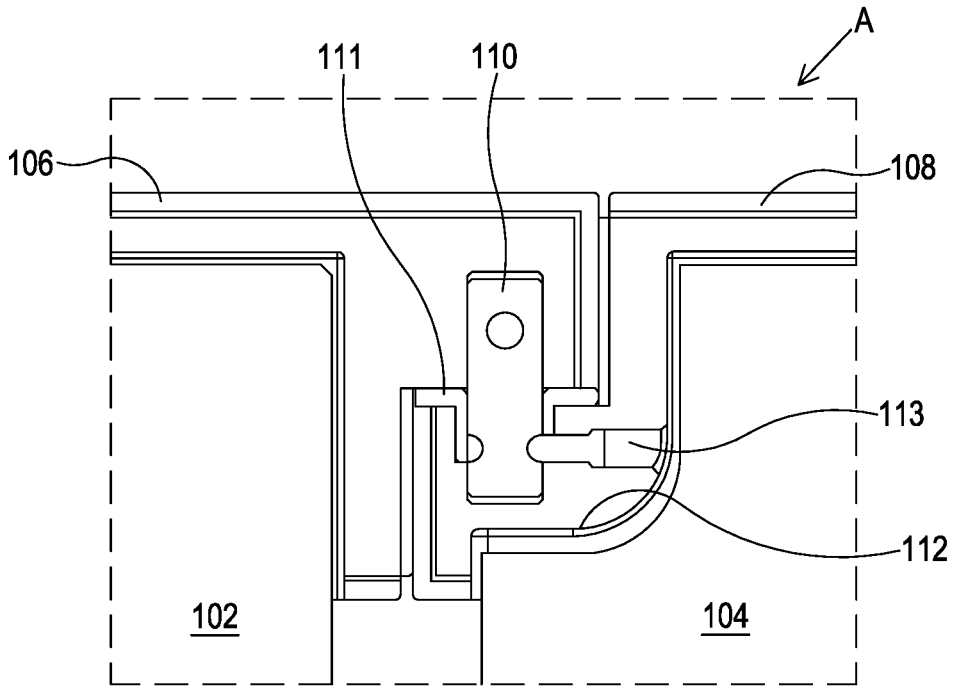
FIG. 3 shows an enlarged view of portion A of FIG. 2.

In the embodiment shown in FIGS. 1 to 3, the second hinge member 108 is connected to the cubicle panel 104 so as to be at least partially within a recessed region of the cubicle panel 104. The first hinge member 106, when connected to the second hinge member 108, is also at least partially within a recessed region 112 of the cubicle panel 104.

The recessed region 112 of the cubicle panel 104 is approximately rectangular in the embodiment shown, and located in a top corner region of the cubicle panel 104. In alternative embodiments, the recessed region 112 may be sized or shaped differently, and/or may be located away from a corner region of the cubicle panel 104.

In the embodiment being described, the recessed region 112 is located at the top of a panel 104, and a further recessed region (not shown) and further hinge assembly (not shown) are located at the bottom of the panel 104. In alternative or additional embodiments, the recessed regions 112 may be spaced from the top and bottom of the panel 104.

In the embodiment being described, the shower door 102 is closed when the shower door 102 is perpendicular to the cubicle panel 104. This arrangement may be used, for example, when two panels 102, 104 are used to enclose a corner of a room, walls of the room providing the remaining two sides of a shower cubicle with a rectangular cross section. In alternative embodiments, the shower door 102 is closed when the shower door 102 is parallel to the cubicle panel 104. This arrangement may be used, for example, when a wall of the shower cubicle has a length of two or more panels 102, 104. The skilled person will appreciate that other angles may be appropriate for other shower cubicle geometries.

In the embodiment being described, the first and second hinge members 106, 108 are substantially symmetrical (in overall shape, even if the parts 106*a*, 106*b* are not symmetrical). Each hinge member 106, 108 has a body portion 118*a*, 118*b* arranged to be connected to a panel 102, 104. Each hinge member 106, 108 has a neck portion 116*a*, 116*b*, extending from its respective body portion 118*a*, 118*b*.

In the embodiment being described with respect to FIG. 1, the majority of each neck portion 116*a*, 116*b* and of each body portion 118*a*, 118*b* is provided by the first part 106*a*, 108*a* of each hinge member 106, 108.

In the embodiment being described with respect to FIG. 7, half of each neck portion 116*a*, 116*b* and of each body portion 118*a*, 118*b* is provided by each part 706*a*, 706*b*, 708*a*, 708*b* of each hinge member 706, 708.

Each neck portion 116*a*, 116*b* extends over a portion of the height of the respective body portion 118*a*, 118*b* from which it extends. In the embodiment being described, each neck portion 116*a*, 116*b* extends over half of the height of the respective body portion 118*a*, 118*b*. As such, when the body portions 118*a*, 118*b* are vertically aligned and oriented for connection, the neck portions 116*a*, 116*b* are vertically adjacent to each other. The neck portions 116*a*, 116*b* are coupled together so as to form the hinge.

The portion of the height of the body portion 118*a*, 118*b* from which the neck portion 116*a*, 116*b* does not extend forms a cooperating surface 114*a*, 114*b* arranged to cooperate with the neck portion 116*b*, 116*a* of the opposing hinge member 108, 106. The neck portion 116*a*, 116*b* of each hinge member 106, 108 therefore extends from the respective body portion 118*a*, 118*b* and is arranged to lie vertically adjacent to the neck portion 116*b*, 116*a* extending from the other hinge member 108, 106 and horizontally adjacent to the cooperating surface 114*b*, 114*a* of the body portion 118*b*, 118*a* of the other hinge member 108, 106.

The cooperating surface 114*a*, 114*b* of each body portion 118*a*, 118*b* and a surface of the opposing neck portion 116*b*, 116*a* are shaped to cooperate with each other, as shown in FIG. 4.

In the embodiments being described, the first hinge member 106 and the second hinge member 108 are at least substantially symmetrical and at least substantially are mirror images of each other, such that the hinge assembly 100 is unhanded.

The cooperating surface 114*a*, 114*b* of the body portion 118*a*, 118*b* and the opposing neck portion 116*b*, 116*a* are shaped to cooperate with each other such that, as the angle between the panels 102, 104 decreases, the cooperating surface of the body portion 118*a*, 118*b* of one hinge member 106, 108 is received within a space provided by the narrowing of the other hinge member 108, 106 in the region of the neck portion 116*b*, 116*a* of that hinge member. The neck portion 116*a*, 116*b* being narrower than the body portion 118*a*, 118*b* therefore provides additional space for the opposing body portion 118*b*, 118*a* to move into, as compared to a neck portion having the same width as the body portion.

In the embodiment being described, the cooperating surface 114*a*, 114*b* of each body portion 118*a*, 118*b* is substantially flat for at least 50% of the width of the body portion. The end region of each body portion 118*a*, 118*b* is curved at each side, bringing the sides in to meet the substantially flat area of the cooperating surface 114*a*, 114*b*. In the embodiment being described, the curvature is relatively gradual (around point D in FIG. 4) away from the substantially flat area and becomes steeper as it reaches the substantially flat area (around point E in FIG. 4).

In the embodiment being described, the curvature can be modelled as two adjacent segments of semi-circles. The segment leading away from the bulk of the body portion 118*a*, 118*b* has an effective diameter of 20 mm. The segment leading on from that to the substantially flat area has an effective diameter of 6 mm.

In the embodiment being described, the neck portion 116*a*, 116*b* is curved. In particular, the neck portion 116*a*, 116*b* is substantially semi-circular.

In the embodiment being described, the neck portion 116*a*, 116*b* is narrower than the body portion 118*a*, 118*b*. As a result, space is provided for the opposing body portion 118*b*, 118*a*, as shown in FIG. 4. In the embodiment being described, the semi-circular shape has a diameter of 16 mm in the embodiment being described, as compared to a hinge member 106, 108 width, W, of 25 mm. Width W is parallel to the diameter and perpendicular to the hinge axis. Point F in FIG. 4 illustrates the curve used to assess this diameter.

Where the neck portion 116*a*, 116*b* joins the body portion 118*a*, 118*b*, the hinge member 106, 108 is curved. In the embodiment being described, a substantially S-shaped curve is formed at each side of the hinge member 106, 108. Modelling the curve as a combination of two segments of semi-circles, facing in opposite directions, the effective diameter is 20 mm at both point B and point C, as marked in FIG. 4. In alternative embodiments, one side of the hinge member may be flat; in such embodiments the neck portion 116 may be offset from a centre line of the body portion 118. In such embodiments, there may be a curve or step inwards towards (or indeed past) the centre line of the hinge member where the neck joins the body from one side of the hinge member only (the side opposite the flat side). In various embodiments, including the embodiment being described, the neck portion 116 is aligned with the centre line of the body portion 118. In such embodiments, there may be symmetrical curves or steps inwards towards the centre line of the hinge member where the neck joins the body.

The cooperating surface 114*b*, 114*a* of each body portion 118*b*, 118*a* is substantially parallel to the tangent (line marked T in FIG. 9) to the curve—i.e. perpendicular to the normal to the curve (line marked N in FIG. 9)—of the neck portion 116*a*, 116*b* of the opposing hinge member 106, 108 at the closest point between the neck portion 116*a*, 116*b* and the cooperating surface 114*b*, 114*a* at all angles of rotation.

FIGS. 2 and 3 show a cross-sectional view of the shower door assembly 100.

A hinge pin 110 forms the hinge axis of the hinge assembly 106, 108. The hinge pin 110 is connected between the first and second neck portions 116*a*, 116*b*.

In the embodiment being described, the hinge pin 110 is a separable element which is engagingly received in a cavity within each of the first and second hinge members 106, 108. In alternative embodiments, the hinge pin 110 may be formed integrally with either the first hinge member 106 or the second hinge member 108, and be engagingly received by the other.

A pad 111 is provided between the neck portions 116*a*, 116*b*. The pad may be described as an anti-abrasion pad 111 as it is arranged to provide a low-friction and hard-wearing surface to facilitate relative rotation of the neck portions 116*a*, 116*b* in use. The anti-abrasion pad 111 is connected to the uppermost surface of the second neck portion 116*b* and allows the first neck portion 116*a* to rotate smoothly above it. In addition, the pad is arranged to reduce or prevent any frictional movement, and to reduce or prevent movement of the return panel when it is released.

In the embodiment being described, a locking screw 113 is provided. The locking screw 113 is arranged to prevent the hinge pivot from moving out of position.

In the embodiment being described, a stop-pad 120 is provided on each cooperating surface 114*a*, 114*b*. Each stop-pad 120 extends across the substantially flat area of the cooperating surface 114*a*, 114*b* in this embodiment; in alternative or additional embodiments, the stop-pad 120 may extend across the whole of the cooperating surface 114*a*, 114*b*, and/or multiple separate stop-pads 120 may be provided to cover different areas of the cooperating surface 114*a*, 114*b*.

In alternative or additional embodiments, one or more stop-pads 120 may be provided on the surface of the neck portion 116*a*, 116*b* instead of, or as well as, on the cooperating surface 114*a*, 114*b* of the body portion 118*a*, 118*b*.

The stop-pad 120 is arranged to cushion the hinge. In particular, the stop-pad 120 is arranged to reduce scratching or scraping between the neck portion 116*a*, 116*b* and the opposing cooperating surface 114*b*, 114*a*.

The stop-pad 120 is made of a resilient material. In the embodiment being described, Acetal is used. In alternative or additional embodiments, Nylon 6,6 or another suitable material may be used.

In the embodiment being described, the stop-pad 120 is substantially planar.

The stop-pad 120 comprises two projections 122*a*, 122*b* from its rear face. In use, the projections 122*a*, 122*b* fit engagingly into corresponding indentations 124*a*, 124*b* in the cooperating surface 114*a*, 114*b*. In the embodiment being described, the projections 122*a*, 122*b* are made of the same resilient, compliant material as the rest of the stop-pad 120, and are held into the indentations 124*a*, 124*b* by friction, after being compressed to fit within the indentations 124*a*, 124*b*. In additional or alternative embodiments, adhesive and/or a different connection means may be used to connect the stop-pad 120 to the cooperating surface (or to the surface of the neck portion 116*a*, 116*b*, in relevant embodiments).

Figure 6:
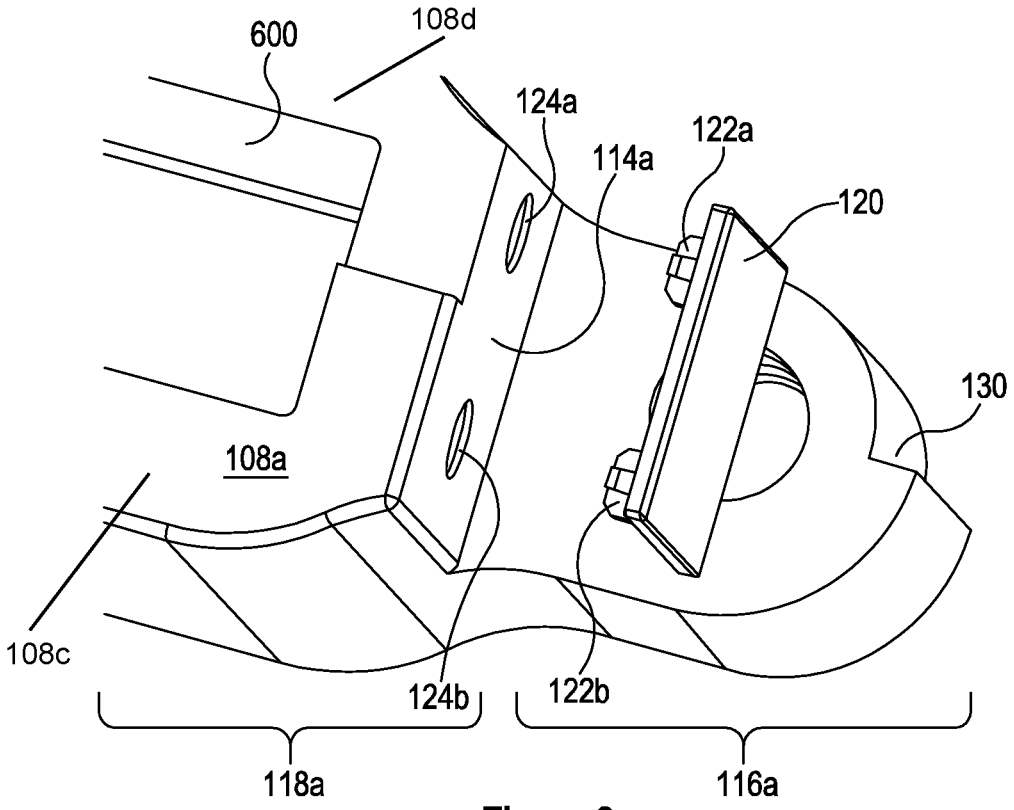
FIG. 6 shows an exploded view of a first hinge member and a stop pad according to an embodiment.
Figure 9:
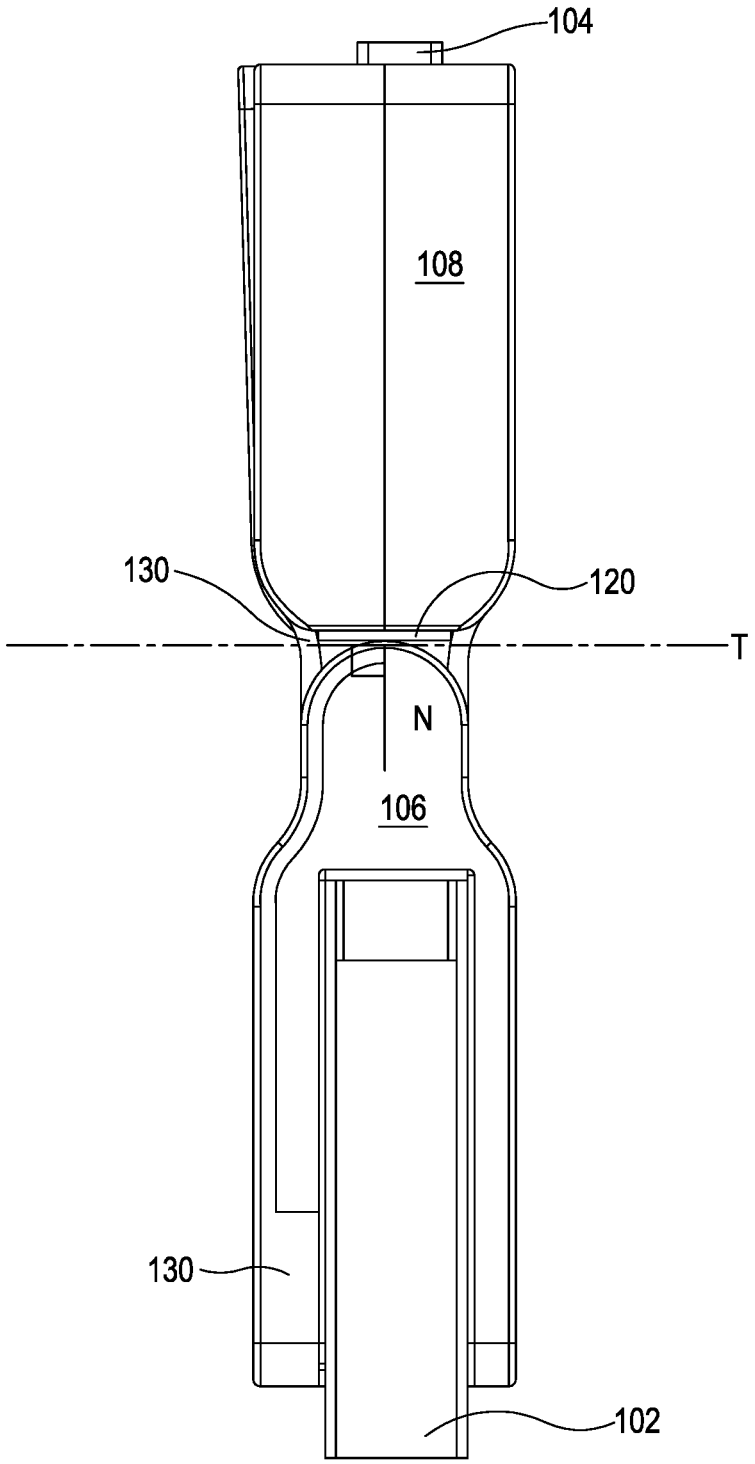
FIG. 9 shows a schematic plan view of a hinge assembly with stop-pad.
Figure 10:
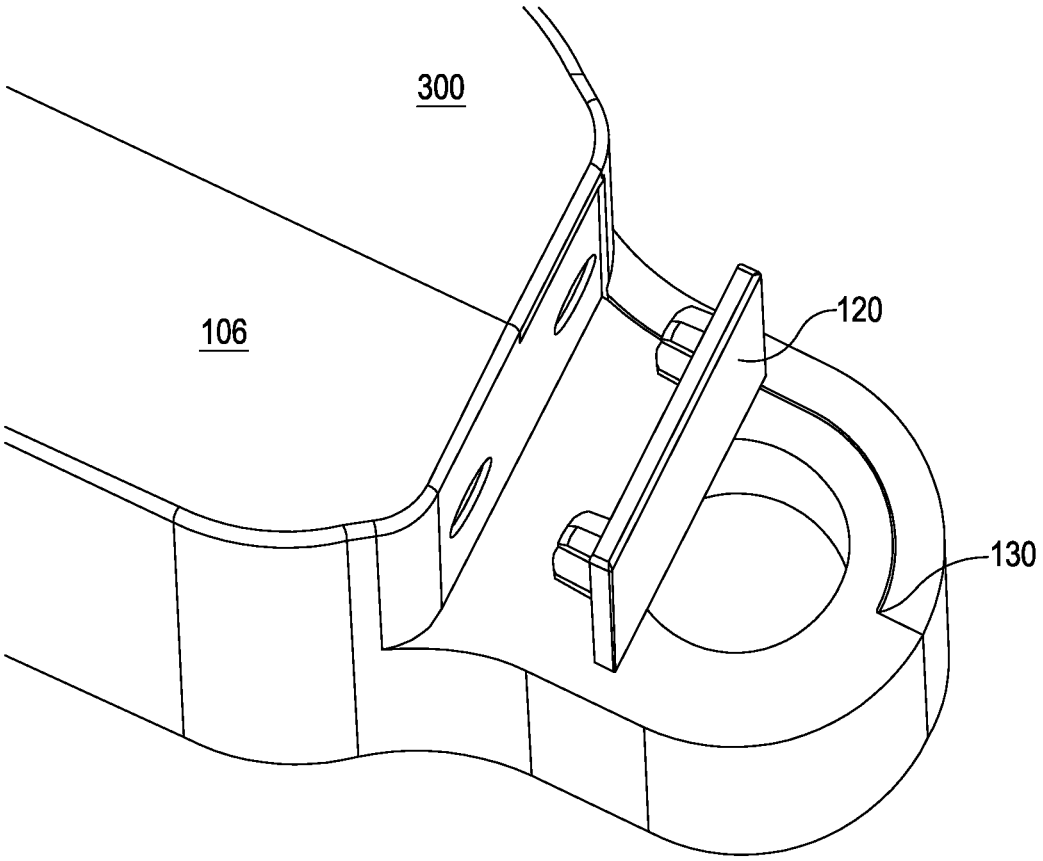
FIG. 10 shows the exploded view of FIG. 6 with a cover in place.

In FIG. 6, a step 130 can be seen in the shape of the first part 108*a* second hinge member 108. This step 130 is arranged to receive a cover 300 (the second part 108*b*) as shown in FIGS. 9 and 10. As shown in FIG. 9, the first hinge member 106 is symmetrical in that the second part 108*b* is also a cover 300.

As can be seen in FIG. 9, the cover 300 extends so as to cover all portions of the first part 108*a* of the second hinge member 108 that would otherwise be visible from a first side of the hinge (the left hand side in the orientation shown in FIG. 9). The step 130 allows a smooth shape of the neck portion 116*a*, 116*b* surface to be maintained. The neck portion 116*a*, 116*b* is therefore formed by the combination of the first part 106*a*, 106*b* of the hinge member 106, 108 and the cover 130. This combination is referred to generally as the hinge member 106, 108—i.e., in use, the cover 130 effectively forms the second part 106*b*, 108*b* of the hinge member 106, 108.

In the embodiment being described, the cover 300 is made of plastic. In the embodiment being described, the cover 300 has a colour and surface finish chosen based on aesthetic considerations. The skilled person will appreciate that additional or alternative materials could be used in additional or alternative embodiments, for example metal.

In alternative embodiments, the second hinge member 108 is provided as a single body, without a plastic cover 300/second part. In such embodiments, no step 130 may be present and the hinge member 108 may instead have a smooth profile. The skilled person will appreciate that the same can apply to the first hinge member 106.

Figure 8:
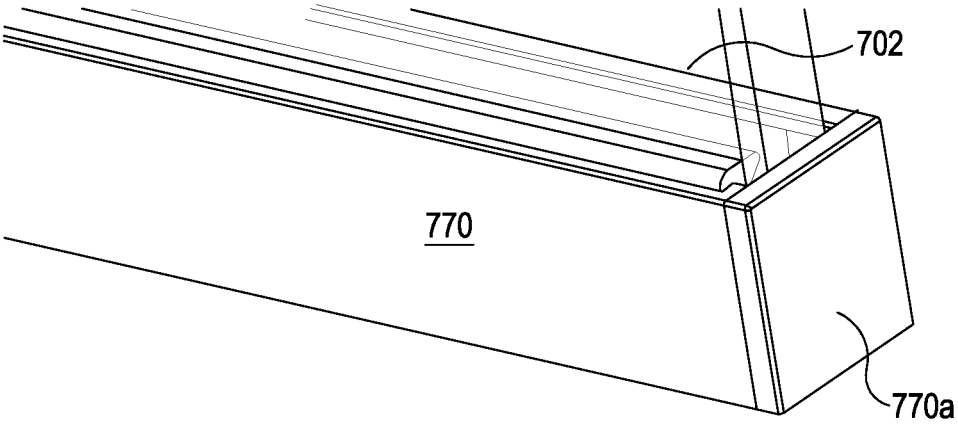
Figure 8 (PRIOR ART)
FIG. 8 (Prior Art) shows a section of the prior art shower door prior to retrofitting of the hinge assembly.

FIGS. 7 and 8 illustrate mounting of a hinge assembly 700 onto the bottom of a prior art panel 702. In the embodiment shown in FIG. 7, the hinge member 706 is arranged to be fitted to the panel 702 as a retrofit option. There is no recessed region in the panel 702—the hinge member 706 is therefore located around the edges of the panel 702 and not within the panel's footprint.

As shown in FIG. 8, prior art panels 702 often have frames 770—the frames 770 often comprise aluminium sections 770 along the lower and upper edges (the skilled person will appreciate that aluminium is commonly used, but that other materials can be used instead of or as well as aluminium).

The hinge member 706 therefore has an integrated bottom H-section to allow the end of the aluminium section 770 to be enclosed within the hinge member 706. The plates 706*a*, 706*b* are spaced so as to allow the frame 770 to fit therebetween, and shaped to match the step between the frame 770 and the face of the panel 702, so that the hinge member 706 forms an engaging fit to both the frame 770 and the panel 702. There is therefore no need to remove the aluminium section 770 before fitting the hinge member. The hinge member 706 provides the required space to incorporate and hide a part of the bottom aluminium section 770. End piece 770*a* of the aluminium section 770 may be removed to allow the hinge member 706 to be fitted flush with the edge of the panel 702.

The installation of the hinge member 706 is therefore a simple procedure, and a neat transition from the aluminium section 770 to the hinge member 706. The bottom aluminium section 770 remains water-tight even after the installation of the hinge 706, as no seals are removed or cut.

What is claimed is:

1. A hinge assembly for a shower door comprising a first panel rotatably connected to a second panel, the hinge assembly comprising:

a first hinge member having a first body portion arranged to be attached to the first panel and also having a first neck portion, the first hinge member being arranged to allow rotation of the first panel with respect to the second panel about a hinge axis, wherein at least a portion of the first body portion is arranged to be connected to the first panel so as to lie at least partially within a recessed region of the first panel, such that the hinge axis lies within a footprint of the first panel, and wherein the first body portion has a first body portion cooperating surface and the first neck portion has a first neck portion cooperating surface; and a second hinge member having a second body portion arranged to be attached to the second panel such that the hinge axis lies outside a footprint of the second panel, and also having a second neck portion arranged to be rotatably connected to the first neck portion to allow the rotation of the first panel with respect to the second panel about the hinge axis, and wherein the second body portion has a second body portion cooperating surface and the second neck portion has a second neck portion cooperating surface;

wherein the first and second neck portions have narrower widths than the first and second body portions and are shaped to prevent the hinge members from colliding with each other as the panels rotate towards each other, the widths being measured parallel to panel width of the respective first or second panel, and wherein:

the cooperating surfaces of the first body portion and the second neck portion are shaped to cooperate with each other such that, as the angle between the panels decreases, the cooperating surface of the first body portion of the first hinge member is received within a space provided by the narrowing of the second hinge member in the region of the second neck portion, and the cooperating surfaces of the second body portion and the first neck portion are shaped to cooperate with each other such that, as the angle between the panels decreases, the cooperating surface of the second body portion of the second hinge member is received within a space provided by the narrowing of the first hinge member in the region of the first neck portion.

2. The hinge assembly of claim 1, wherein the cooperating surface of the body portion of each hinge member is shaped to cooperate with a surface of the neck portion of the other hinge member such that water egress between the cooperating surface and the neck is substantially blocked at any angle of rotation of the panels.

3. The hinge assembly of claim 1, wherein the first hinge member and the second hinge member are symmetrical and are mirror images of each other, such that the hinge assembly is unhanded.

4. The hinge assembly of claim 1, wherein the neck portion of each hinge member extends from the body portion and is arranged to lie vertically adjacent to the neck portion extending from the other hinge member and horizontally adjacent to the cooperating surface of the body portion of the other hinge member.

5. The hinge assembly of claim 2, wherein the cooperating surface is substantially flat for at least 50% of the width of the body portion.

6. The hinge assembly of claim 5, wherein the neck portion is curved, and the cooperating surface is substantially parallel to the tangent to the curve of the neck portion of the opposing hinge member at the closest point between the neck portion and the cooperating surface at all angles of rotation.

7. The hinge assembly of claim 1, wherein the end region of the neck portion arranged to cooperate with the opposing hinge member is curved, and is substantially semi-circular in cross-section.

8. The hinge assembly of claim 7, wherein the diameter of the substantially semi-circular end region is between 45% and 75% of the thickness of the body portion.

9. The hinge assembly of claim 8, wherein the diameter of the substantially semi-circular end region is between 60% and 70% of the thickness of the body portion.

10. The hinge assembly of claim 8, wherein the diameter of the substantially semi-circular end region is around 65% of the thickness of the body portion.

11. The hinge assembly of claim 1, wherein the hinge assembly is arranged such that a gap between the panels is narrow.

12. The hinge assembly of claim 11, wherein the gap has a maximum width of 13 mm at any angle of rotation.

13. The hinge assembly of claim 1, wherein the hinge assembly comprises at least onestop-pad, the or each stop-pad being arranged to be attached to either the first hinge member or the second hinge member and arranged to prevent contact between a surface of the first hinge member and a surface of the second hinge member at any angle of rotation.

14. The hinge assembly of claim 13, wherein the hinge assembly comprises two stop-pads, one on the first hinge member and one on the second hinge member.

15. The hinge assembly of claim 1, wherein each hinge member comprises a screwcover arranged to follow the profile of the hinge member, cover any screws, and provide a uniform, unhanded shape to the hinge member.

16. A shower door comprising:

a first panel comprising a recessed region;

a second panel; and a hinge assembly comprising:

a first hinge member having a first body portion arranged to be attached to the first panel and also having a first neck portion, the first hinge member being arranged to allow rotation of the first panel with respect to the second panel about a hinge axis, wherein at least a portion of the first body portion is arranged to be connected to the first panel so as to lie at least partially within a recessed region of the first panel, such that the hinge axis lies within a footprint of the first panel, and wherein the first body portion has a first body portion cooperating surface and the first neck portion has a first neck portion cooperating surface; and a second hinge member having a second body portion arranged to be attached to the second panel such that the hinge axis lies outside a footprint of the second-panel, and also having a second neck portion arranged to be rotatably connected to the first neck portion to allow the rotation of the first panel with respect to the second panel about the hinge axis, and wherein the second body portion has a second body portion cooperating surface and the second neck portion has a second neck portion cooperating surface;

wherein the first and second neck portions have narrower widths than the first and second body portions and are shaped to prevent the hinge members from colliding with each other as the panels rotate towards each other, the widths being measured parallel to panel width of the respective first or second panel, and wherein:

the cooperating surfaces of the first body portion and the second neck portion are shaped to cooperate with each other such that, as the angle between the panels decreases, the cooperating surface of the first body portion of the first hinge member is received within a space provided by the narrowing of the second hinge member in the region of the second neck portion; and the cooperating surfaces of the second body portion and the first neck portion are shaped to cooperate with each other such that, as the angle between the panels decreases, the cooperating surface of the second body portion of the second hinge member is received within a space provided by the narrowing of the first hinge member in the region of the first neck portion.

17. A shower cubicle comprising a hinge assembly, the hinge assembly comprising:

a first hinge member having a first body portion arranged to be attached to the first panel and also having a first neck portion, the first hinge member being arranged to allow rotation of the first panel with respect to the second panel about a hinge axis, wherein at least a portion of the first body portion is arranged to be connected to the first panel so as to lie at least partially within a recessed region of the first panel, such that the hinge axis lies within a footprint of the first panel, and wherein the first body portion has a first body portion cooperating surface and the first neck portion has a first neck portion cooperating surface; and a second hinge member having a second body portion arranged to be attached to the second panel such that the hinge axis lies outside a footprint of the second panel, and also having a second neck portion arranged to be rotatably connected to the first neck portion to allow the rotation of the first panel with respect to the second panel about the hinge axis, and wherein the second body portion has a second body portion cooperating surface and the second neck portion has a second neck portion cooperating surface;

wherein the first and second neck portions have narrower widths than the first and secondbody portions and are shaped to prevent the hinge members from colliding with each other as the panels rotate towards each other, the widths being measured parallel to panel width of the respective first or second panel, and wherein:

the cooperating surfaces of the first body portion and the second neck portion are shaped to cooperate with each other such that, as the angle between the panels decreases, the cooperating surface of the first body portion of the first hinge member is received within a space provided by the narrowing of the second hinge member in the region of the second neck portion; and the cooperating surfaces of the second body portion and the first neck portion are shaped to cooperate with each other such that, as the angle between the panels decreases, the cooperating surface of the second body portion of the second hinge member is received within a space provided by the narrowing of the first hinge member in the region of the first neck portion.

* * * * *